US011686004B2

(12) United States Patent
Wu et al.

(10) Patent No.: US 11,686,004 B2
(45) Date of Patent: Jun. 27, 2023

(54) GAS DIFFUSION ELECTRODES WITH SEGMENTED CATALYST LAYERS FOR CO2 REDUCTION

(71) Applicant: University of Cincinnati, Cincinnati, OH (US)

(72) Inventors: Jingjie Wu, Mason, OH (US); Xiaojie She, Cincinnati, OH (US); Tianyu Zhang, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 0 days.

(21) Appl. No.: 17/077,783

(22) Filed: Oct. 22, 2020

(65) Prior Publication Data

US 2021/0115577 A1 Apr. 22, 2021

Related U.S. Application Data

(60) Provisional application No. 63/040,017, filed on Jun. 17, 2020, provisional application No. 62/924,438, filed on Oct. 22, 2019.

(51) Int. Cl.

| | |
|---|---|
| ***C25B 11/032*** | (2021.01) |
| ***C25B 3/26*** | (2021.01) |
| ***C25B 11/053*** | (2021.01) |
| ***C25B 11/081*** | (2021.01) |
| ***C25B 11/077*** | (2021.01) |
| ***C25B 1/50*** | (2021.01) |
| ***C25B 1/23*** | (2021.01) |
| ***C25B 3/03*** | (2021.01) |
| ***C25B 11/091*** | (2021.01) |

(52) U.S. Cl.

CPC ..... *C25B 11/032* (2021.01); *C25B 1/23* (2021.01); *C25B 1/50* (2021.01); *C25B 3/03* (2021.01); *C25B 3/26* (2021.01); *C25B 11/053* (2021.01); *C25B 11/077* (2021.01); *C25B 11/081* (2021.01); *C25B 11/091* (2021.01)

(58) Field of Classification Search

None

See application file for complete search history.

(56) References Cited

U.S. PATENT DOCUMENTS

2013/0228470 A1* 9/2013 Chen ..... C25B 3/23 205/462

OTHER PUBLICATIONS

Lum et al. (Energy Environ. Sci., 2018, 11, 2935). (Year: 2018).*
Ren et al. (Angew. Chem. Int. Ed. 2019, 58, 15036-15040). (Year: 2019).*

* cited by examiner

*Primary Examiner* — Wojciech Haske
(74) *Attorney, Agent, or Firm* — Brent M. Peebles

(57) ABSTRACT

A tandem electrode for electrochemically reducing carbon dioxide is described. The electrode includes a first distinct catalyst layer and a second distinct catalyst layer. The first distinct catalyst layer is made of a $C_1$ hydrocarbon or $C_{2+}$ product selective catalyst and the second distinct catalyst layer is comprised of a CO selective catalyst. In one embodiment, the second distinct catalyst layer is concentrated at one end of the tandem electrode. In another embodiment, the tandem electrode also includes a microporous layer and a substrate layer.

20 Claims, 14 Drawing Sheets

GAS DIFFUSION ELECTRODES WITH SEGMENTED CATALYST LAYERS FOR CO2 REDUCTION

CROSS REFERENCE TO RELATED APPLICATIONS

This application claims priority to U.S. Provisional Application Ser. No. 62/924,438, filed Oct. 22, 2019, and U.S. Provisional Application Ser. No. 63/040,017 filed Jun. 17, 2020, which applications are hereby incorporated by reference in their entirety.

TECHNICAL FIELD

The present invention relates to gas diffusion electrodes (GDEs) for $CO_2$ electro-reduction.

BACKGROUND OF THE INVENTION

Enabling large-scale electrochemical reduction of $CO_2$ into multi-carbon chemicals and liquid fuels using water as the proton supply can store renewable intermittent electricity as chemical energy while mitigating $CO_2$ emissions. Despite decades of investigation, the rational electrocatalyst that converts $CO_2$ into specific product at a fair Faradaic efficiency (FE) and production rate is still confined to Cu. A variety of strategies have been proposed to tune the selectivity of Cu towards $C_{2+}$ products principally by adjusting the surface morphology to expose preferred facets, modifying surface crystal structure to generate grain boundaries, modulating Cu surface chemical composition to stabilize the $Cu^{\delta+}$ ($0<\delta\leq 1$), and alloying Cu with other metal elements to alter the position of d-band center. However, the selectivity towards a specific $C_{2+}$ product such as ethylene ($C_2H_4$) and ethanol ($C_2H_5OH$) has not been significantly improved compared to commercial Cu nanoparticles. Development of new concepts of catalyst and electrode design is key to simultaneously achieve selectivity, yield and energy efficiency of a specific $C_{2+}$ product at level of industrial relevance.

SUMMARY OF THE INVENTION

The present invention addresses this need with a novel a tandem electrode. In one embodiment, the present invention is a tandem electrode including a first distinct catalyst layer and a second distinct catalyst layer. The first distinct catalyst layer is a $C_1$ hydrocarbon or $C_{2+}$ product selective catalyst and the second distinct catalyst layer is a CO selective catalyst. In one embodiment, the second distinct catalyst layer is concentrated at one end of the tandem electrode. In another embodiment, the tandem electrode also includes a microporous layer. In one embodiment, the tandem electrode also includes a substrate layer. In another embodiment, the substrate layer is selected from the group consisting of carbon fiber, metal foam, and combinations thereof. In one embodiment, the substrate layer is hydrophobic.

In another embodiment, the first distinct catalyst layer is Cu, Cu alloys, doped Cu, nitrogen doped carbon materials, boron doped carbon materials, nitrogen and boron co-doped carbon materials, and functionalized carbon materials. In one embodiment, the second distinct catalyst layer is selected from the group consisting of Au, Ag, ZnO, Fe—N—C, Ni—N—C, Co—N—C, N doped CNT, N doped graphene, and other materials that are selective for the CO formation. In another embodiment, the first distinct catalyst layer is Cu and the second distinct catalyst layer is selected from the group consisting of Ag, ZnO and Fe—N—C. In one embodiment, the ratio of the first distinct catalyst layer to the second distinct catalyst layer is from about infinite to about 1:1. In another embodiment, the ratio of the first distinct catalyst layer to the second distinct catalyst layer is from about 100:1 to about 1:1. In yet another embodiment, the ratio of the first distinct catalyst layer to the second distinct catalyst layer is from about 10:1 to about 1:1

In another embodiment of the present invention, a method of electrochemically reducing carbon dioxide ($CO_2$) is provided. The method involves exposing a gas comprising $CO_2$ to a tandem electrode comprising a first distinct catalyst layer and a second distinct catalyst layer, wherein the first distinct catalyst layer is a $C_1$ hydrocarbon or $C_{2+}$ product selective catalyst and the second distinct catalyst layer is a CO selective catalyst. A voltage is applied to the tandem electrode and a reduction product of carbon dioxide is produced.

DETAILED DESCRIPTION OF THE INVENTION

Figure 1A:
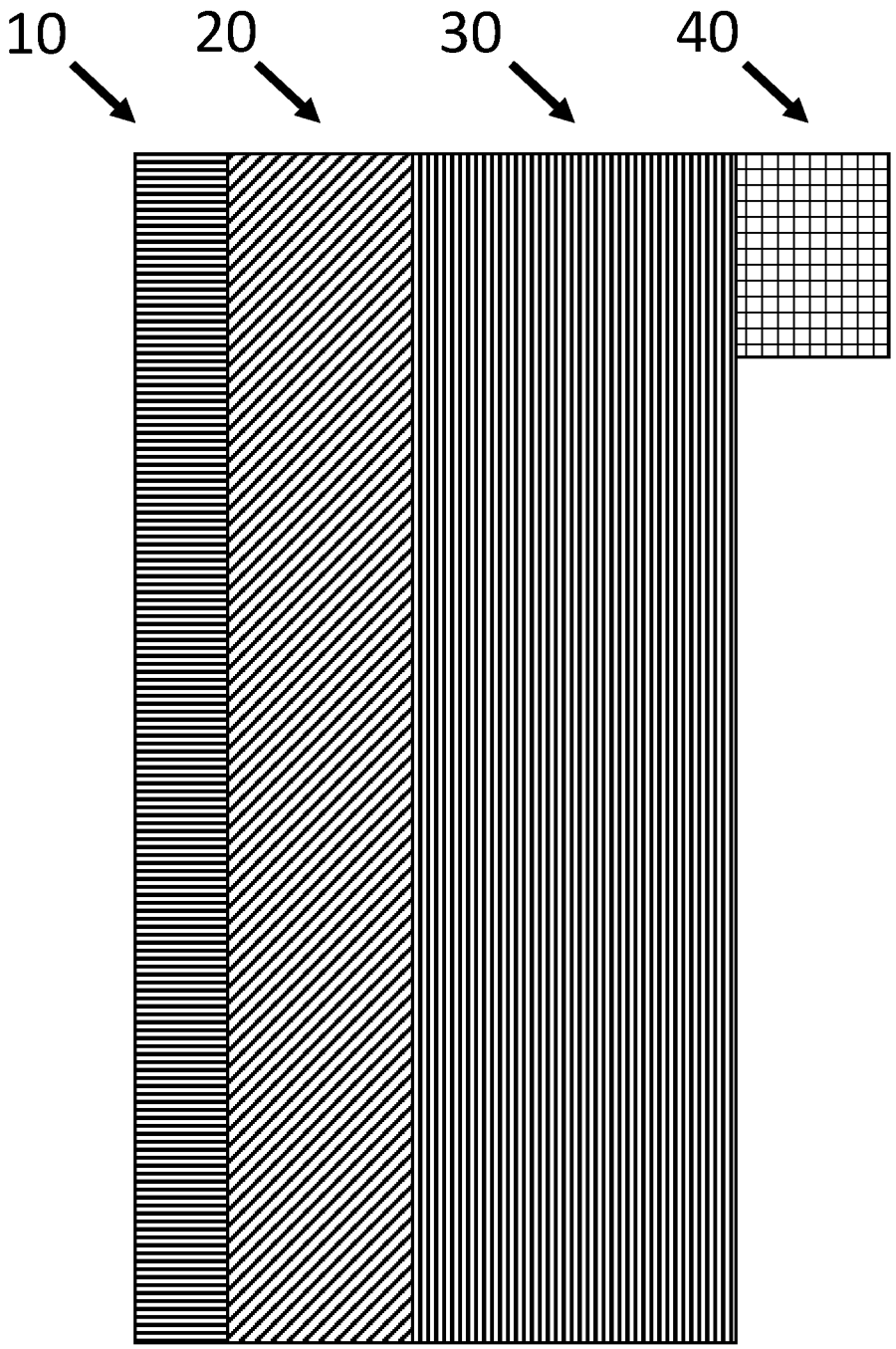
FIG. 1A is an illustration of a cross-sectional schematic of an embodiment of the segmented tandem electrode of the present invention. The embodiment is an L-type segmented tandem electrode with layers of carbon fiber substrate 10, gas diffusion layer 20, $C_1$ hydrocarbon or $C_{2+}$ product-selective catalyst layer 30, and CO selective catalyst layer 40.

The details of one or more embodiments of the disclosed subject matter are set forth in this document. Modifications to embodiments described in this document, and other embodiments, will be evident to those of ordinary skill in the art after a study of the information provided herein.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, in some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

One skilled in the art will recognize that the various embodiments may be practiced without one or more of the specific details described herein, or with other replacement and/or additional methods, materials, or components. In other instances, well-known structures, materials, or operations are not shown or described in detail herein to avoid obscuring aspects of various embodiments of the invention. Similarly, for purposes of explanation, specific numbers, materials, and configurations are set forth herein in order to provide a thorough understanding of the invention. Furthermore, it is understood that the various embodiments shown in the figures are illustrative representations and are not necessarily drawn to scale.

Reference throughout this specification to "one embodiment" or "an embodiment" means that a particular feature, structure, material, or characteristic described in connection with the embodiment is included in at least one embodiment of the invention, but does not denote that they are present in every embodiment. Thus, the appearances of the phrases "in an embodiment" or "in another embodiment" in various places throughout this specification are not necessarily referring to the same embodiment of the invention. Further, "a component" may be representative of one or more components and, thus, may be used herein to mean "at least one."

As used herein, a "layer" refers to a material portion including a region having a thickness. A layer may extend over the entirety of an underlying or overlying structure, or may have an extent less than the extent of an underlying or overlying structure. Further, a layer may be a region of a homogeneous or inhomogeneous continuous structure that has a thickness less than the thickness of the continuous structure. For example, a layer may be located between any pair of horizontal planes between, or at, a top surface and a bottom surface of the continuous structure. A layer may extend horizontally, vertically, and/or along a tapered surface. A substrate may be a layer, may include one or more layers therein, and/or may have one or more layer thereupon.

Although it still remains elusive in revealing full pathway for $C_{2+}$ products formation and the elementary steps that control the product distribution over Cu-based catalysts, a crucial step of C—C coupling through dimerization of adsorbed *CO or coupling of *CO with its hydrogenated derivatives (e.g. *CHO) has been identified by both experimental observation and theoretical calculation. Due to the linear scaling relationship of binding strength for the key intermediates as well as kinetic linear scaling relation between intermediate adsorption and activation energy, simultaneously optimizing the binding strength of each key intermediate (e.g. *CO and *CHO) over a single reactive site is difficult, which results in low energy and Faradaic efficiencies of $C_{2+}$ products on single Cu catalyst. In order to break these two linear scaling relations, bimetallic tandem catalysts were developed, typically by combining Cu with another separated CO-selective metal (e.g., Zn, Au and Ag). Such tandem catalysts exploit CO as the intermediate feedstock to increase CO flux on the Cu surface, which in turn improves the selectivity and production rate of $C_{2+}$ products as well as decreasing the overpotential for $CO_2$ electro-reduction. To properly perform tandem catalysis, the CO-selective catalytic site necessitates to locate atomically adjacent to Cu active site, which requires deliberate synthesis for tandem catalysts. In addition, so far all reported bimetallic catalysts for two-step sequential electrocatalysis pathway have been only demonstrated for aqueous $CO_2$ reduction in H-type electrochemical cell, which assumes that the spill-over of CO intermediate from the CO-selective catalyst site to the adjacent Cu active site is thermodynamically and kinetically feasible. However, the utilization efficiency of CO intermediate species by the Cu sites is hardly controllable in H-type cell due to the random diffusion of CO either between inter-site or to the bulk electrolyte, which potentially results in a lower *CO surface coverage on the Cu surface than would be achievable without diffusion to the bulk. On the other hand, the practical implementation of $CO_2$ electro-reduction in H-type cell is restricted from the low solubility of both $CO_2$ and CO in water, which causes a low current density.

Instead, the flow cell or solid electrolyte cell which incorporates gas diffusion electrodes (GDEs) for gas-phase $CO_2$ being reduced directly along the triple phase boundary, can achieve far higher current density at the industrial scale. Moreover, in contrast to unavoidable diffusion to the bulk electrolyte in H-type cell, the gas products diffuse backward across the active catalyst layers to the microporous carbon layer in the GDE, which offers a great opportunity for full utilization of CO intermediate.

The present invention addresses these issues with a tandem electrode comprising two distinct catalyst layers made of a $C_{2+}$-selective catalyst and a CO-selective catalyst, respectively, to exploit this unique gas transport property in the GDE operated in the flow cell or solid electrolyte cell. In one embodiment, the fabrication of tandem electrodes of the present invention involves sequential spraying of two independent, selective catalyst layers without complex chemical synthesis as required for bimetallic tandem catalysts. The tandem electrodes of the present invention possess the intrinsic benefits of lower onset potential and higher partial current densities of both $C_{2+}$ products than a bare Cu electrode. By correlating the CO production and consumption rates with the loading of CO— and $C_{2+}$-selective catalysts, respectively, the design principle of tandem electrodes of the present invention allows for the manipulation of the FE of $C_{2+}$ products. With the guide of this design principle, the present tandem electrodes reached the highest recorded production efficiency and rate of overall $C_{2+}$ products as well as the specific product of $C_2H_4$ under the identical testing conditions. The tandem electrodes of the present invention break the long-standing belief that two adjacent active sites at the atomic scale are required to perform tandem catalysis of $CO_2$ reduction.

The present invention involves novel structures of tandem gas diffusion electrodes (GDEs) for $CO_2$ electro-reduction. In one embodiment, the tandem GDE of the present invention comprises at least two distinct $CO_2$ electro-reduction catalysts. The first electro-reduction catalyst is a multi-carbon-selective catalyst that converts CO to $C_1$ hydrocarbons or $C_{2+}$ products. Non-limiting examples of $C_1$ hydrocarbons or $C_{2+}$ products include $CH_4$, $C_2H_4$, $C_3H_7OH$, $C_2H_5OH$, $CH_3COO^-$ and $HCOO^-$. In one embodiment, the multi-carbon-selective catalyst is Cu. In another embodiment, the multi-carbon-selective catalyst is a carbon-based material that is selective for hydrocarbon formation. In another embodiment, the multi-carbon-selective catalyst is a copper alloy.

The second electro-reduction catalyst is a CO-selective catalyst that converts $CO_2$ to CO. In one embodiment, the CO-selective catalyst is selected from the group consisting of Au, Ag, Zn, ZnO, Fe—N—C, Ni—N—C, Co—N—C, N doped CNT, N doped graphene, and other materials that are selective for the CO formation. The $C_{2+}$-selective catalyst and the CO-selective catalyst can either be located in the same catalyst layer or in two catalyst layers with partial overlap.

In one embodiment of the tandem electrode of the present invention, the $C_{2+}$-selective catalyst is Cu and the CO-selective catalyst is Ag. In another embodiment, the $C_{2+}$-selective catalyst is Cu and the CO-selective catalyst is ZnO. In yet another embodiment, the multi-carbon-selective catalyst is Cu and the CO-selective catalyst is Fe—N—C.

Figure 1B:
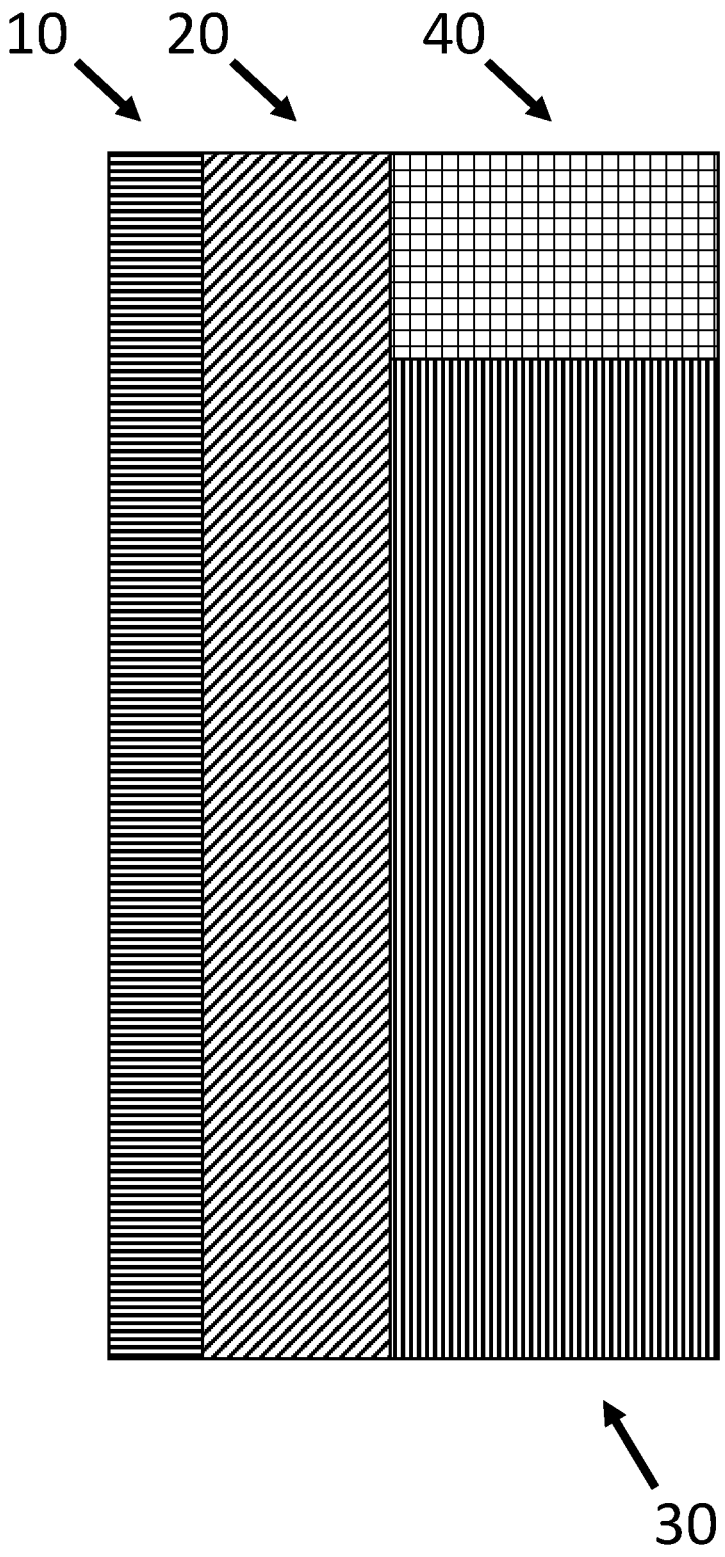
FIG. 1B is an illustration of a cross-sectional schematic of another embodiment of the segmented tandem electrode of the present invention. The embodiment is an I-type segmented tandem electrode with layers 10, 20, 30, and 40 indicating the same type of material as the L-type segmented tandem electrode of FIG. 1A.

FIGS. 1A to 1F are cross-sectional schematic views showing different embodiments of the main structure of the tandem GDE of the present invention. In these figures, the same hatching is used to indicate structural components made of materials having essentially the same structure or function. As shown in FIGS. 1A to 1F, the basic structure of the tandem GDE comprises a substrate layer 10, microporous layer 20 and catalyst layers (CL) 30 and 40. CL 30 is a $C_1$ hydrocarbon or $C_{2+}$ product-selective catalyst while CL 40 is a CO-selective catalyst. In some embodiments, the CL 40 is located close to the gas inlet. In one embodiment, CO-selective catalyst 40 is on the top covering part of catalyst 30 (L-type tandem GDE) as shown in FIG. 1A. In another embodiment, CO-selective catalyst 40 is in the same plane yet in a distinguished area (I-type tandem GDE) as shown in FIG. 1B.

Figure 1C:
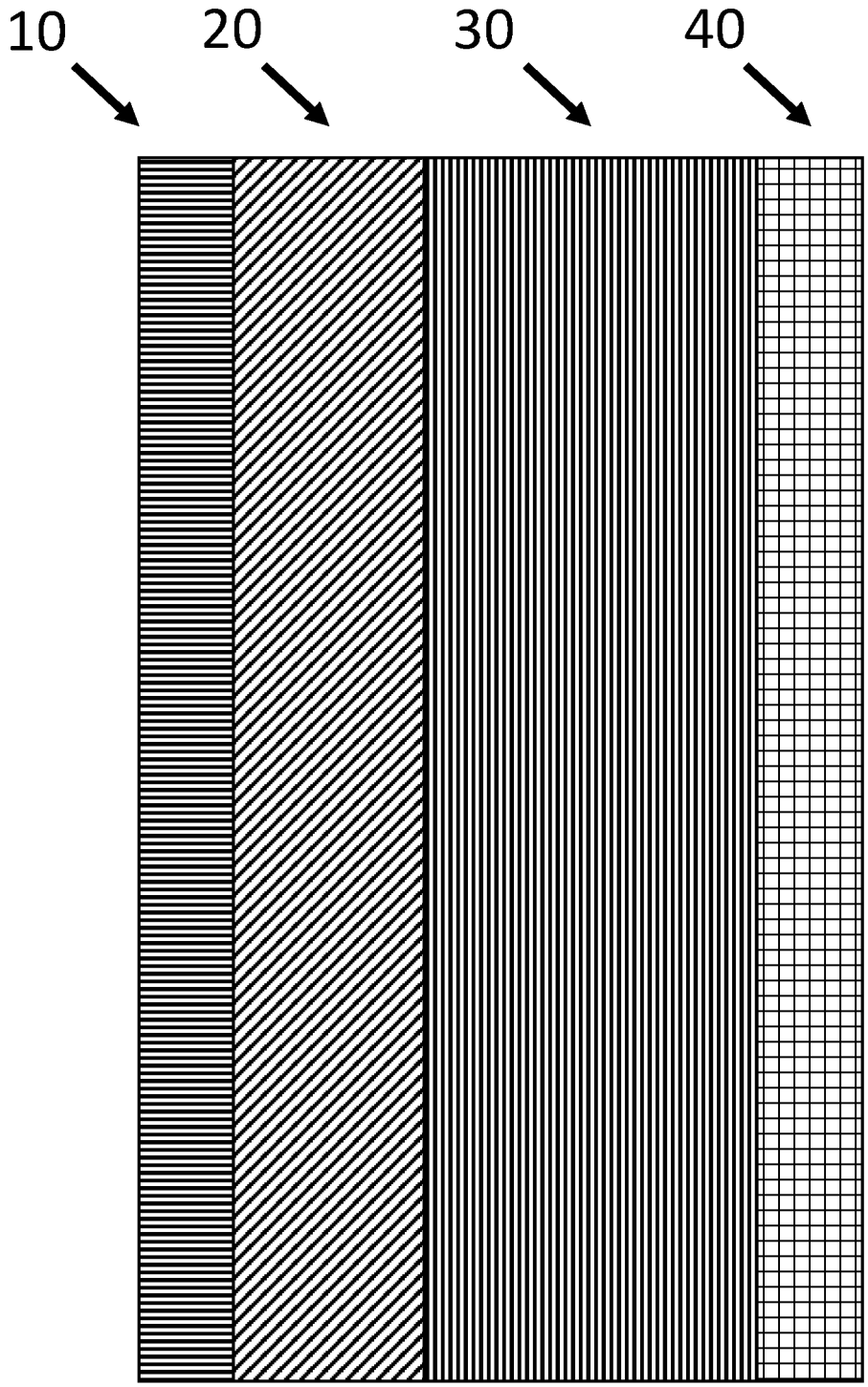
FIG. 1C is an illustration of a cross-sectional schematic of another embodiment of the segmented tandem electrode of the present invention. The embodiment is a layered segmented tandem electrode with layers 10, 20, 30, and 40 indicating the same type of material as the L-type segmented tandem electrode of FIG. 1A.
Figure 1D:
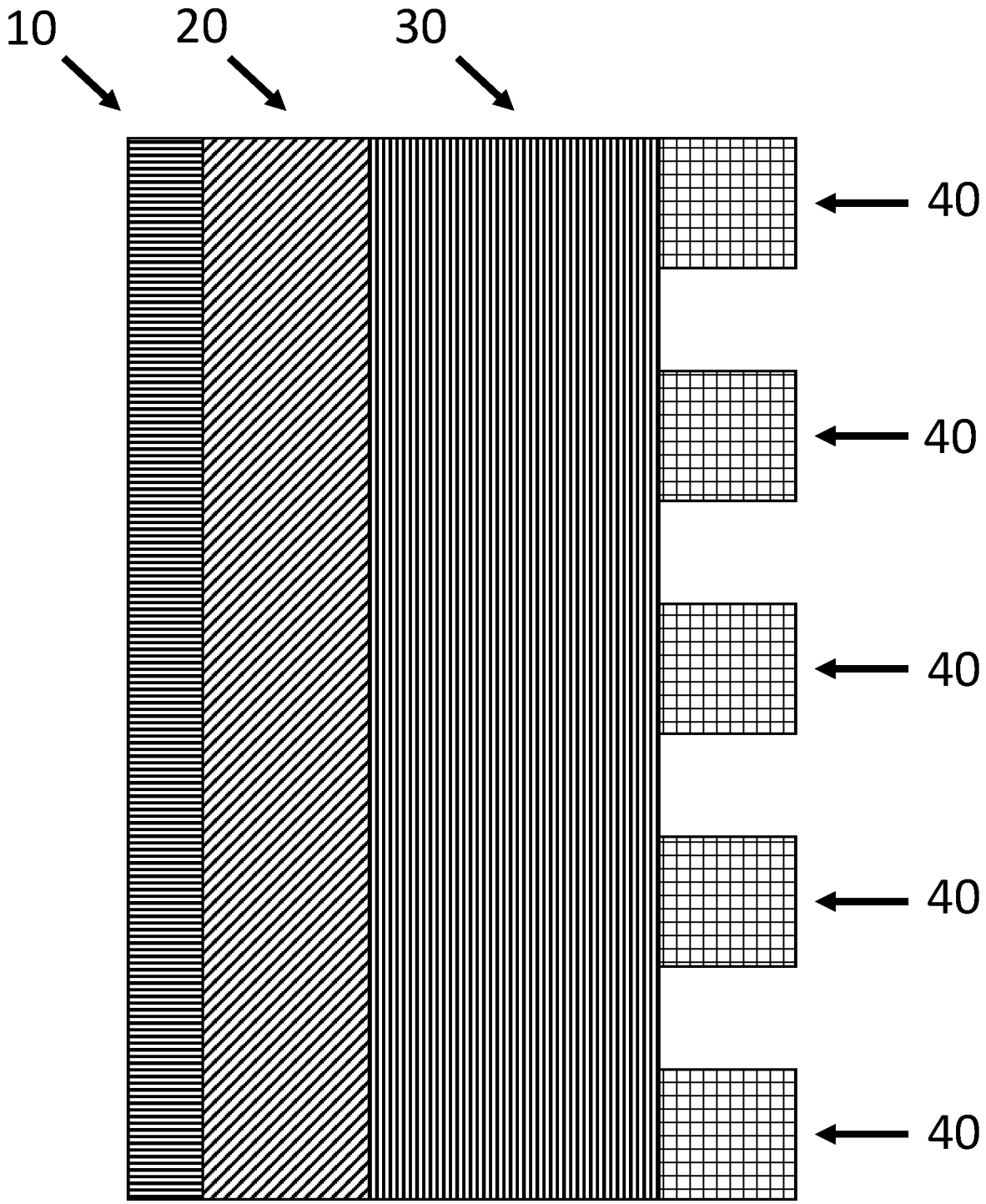
FIG. 1D is an illustration of a cross-sectional schematic of another embodiment of the segmented tandem electrode of the present invention. The embodiment has multiple discrete areas of CO selective catalyst 40. Layers 10, 20 and 30 indicate the same type of material as the L-type segmented tandem electrode of FIG. 1A.
Figure 1E:
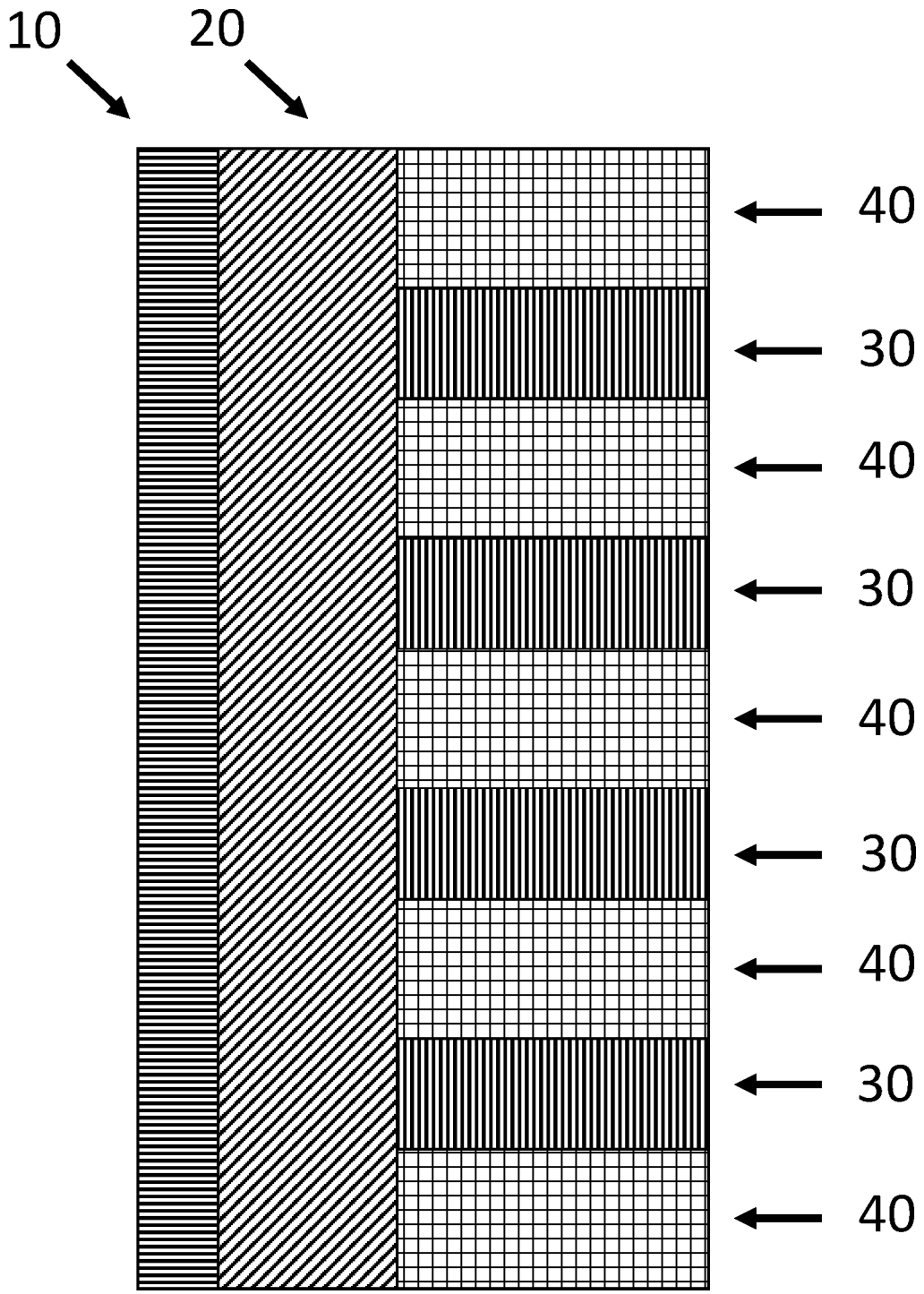
FIG. 1E is an illustration of a cross-sectional schematic of another embodiment of the segmented tandem electrode of the present invention. The embodiment has multiple discrete areas of CO selective catalyst 40. Layers 10, 20 and 30 indicate the same type of material as the L-type segmented tandem electrode of FIG. 1A.
Figure 1F:
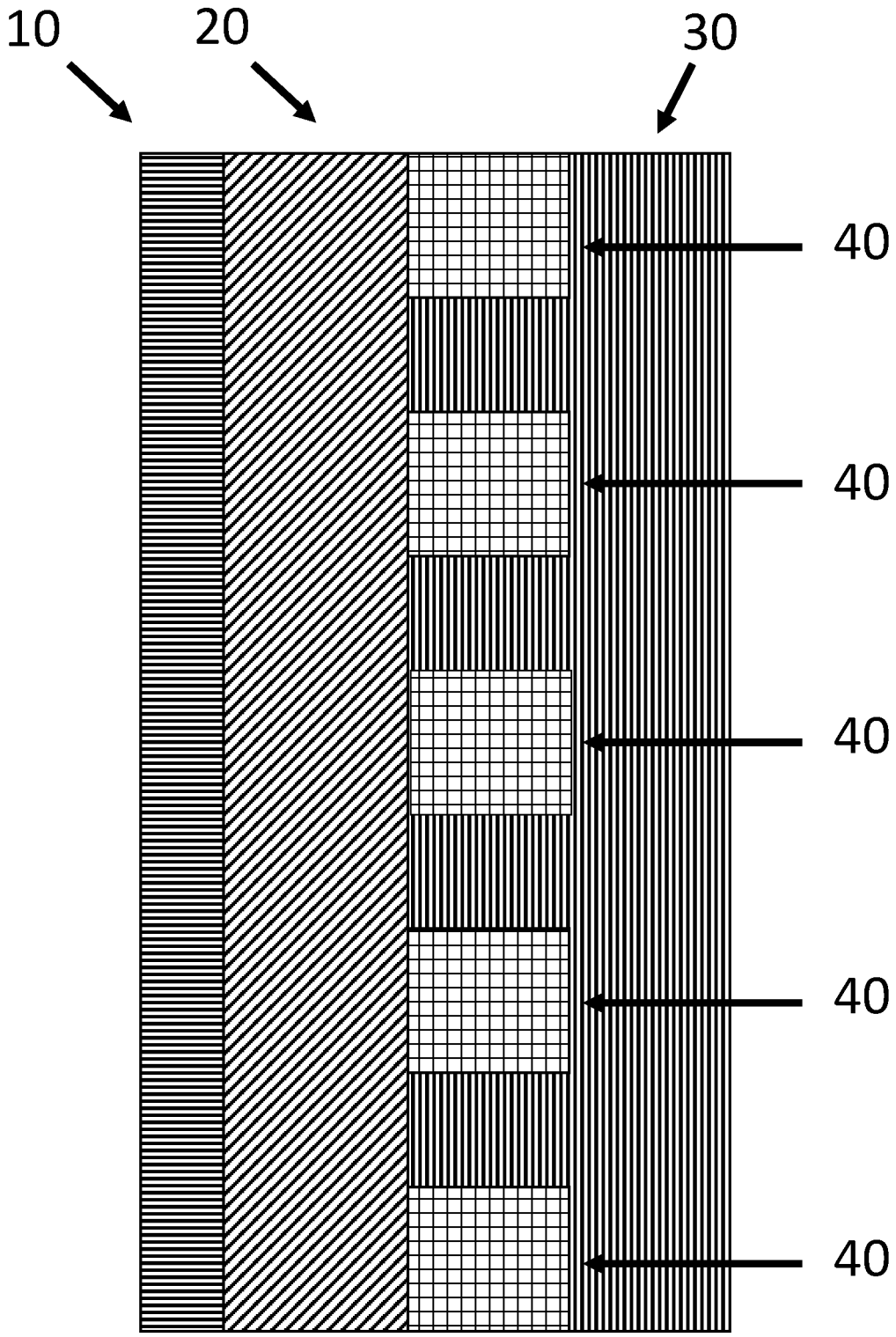
FIG. 1F is an illustration of a cross-sectional schematic of another embodiment of the segmented tandem electrode of the present invention. The embodiment has multiple discrete areas of CO selective catalyst 40. Layers 10, 20 and 30 indicate the same type of material as the L-type segmented tandem electrode of FIG. 1A.
Figure 1G:
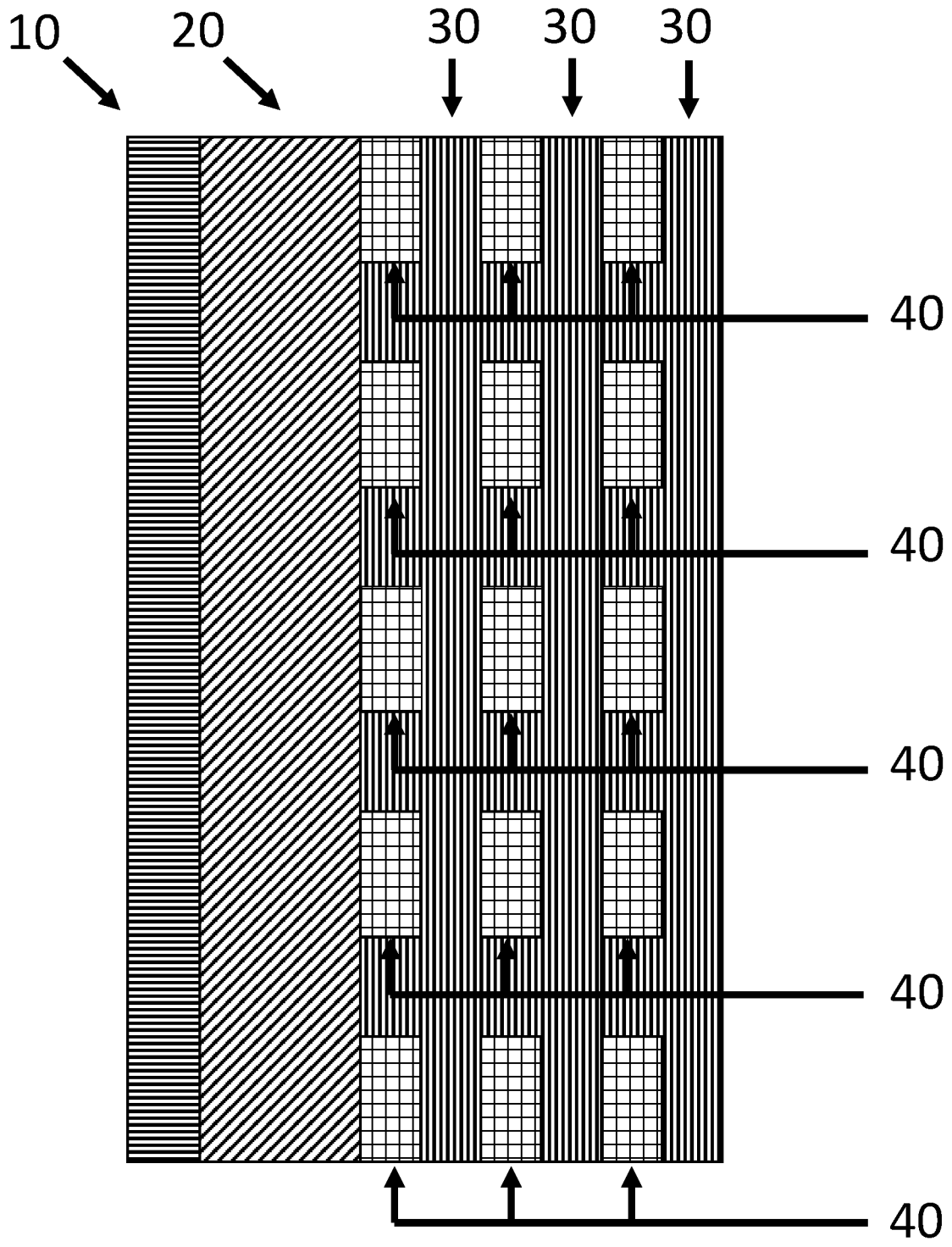
FIG. 1G is an illustration of a cross-sectional schematic of another embodiment of the segmented tandem electrode of the present invention. The embodiment has multiple discrete areas of CO selective catalyst 40. Layers 10, 20 and 30 indicate the same type of material as the L-type segmented tandem electrode of FIG. 1A.
Figure 2A:
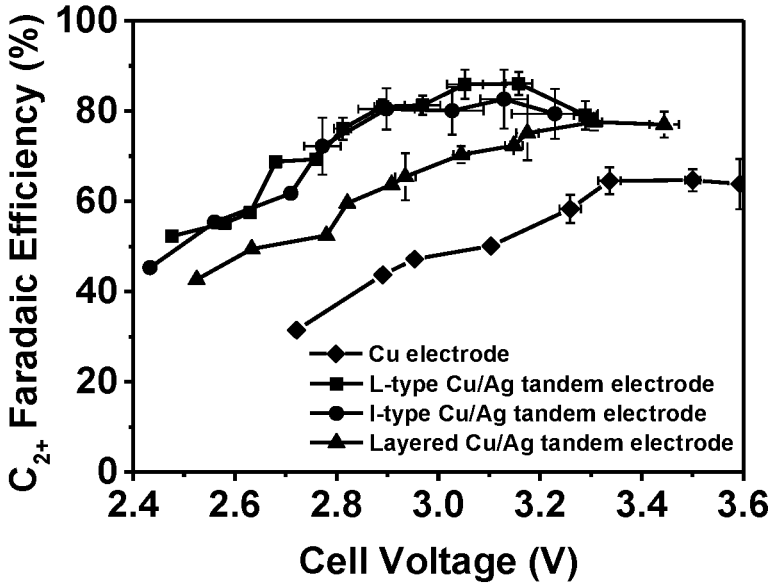
FIG. 2A is a graph showing the $C_{2+}$ product Faradaic efficiency of various electrode designs as a function of cell voltage. The electrodes are a Cu electrode and three embodiments of the present invention—L-type (as shown in FIG. 1A) Cu/Ag, I-type (as shown in FIG. 1B) Cu/Ag, and a layered structure (as shown in FIG. 1C) Cu/Ag.
Figure 2B:
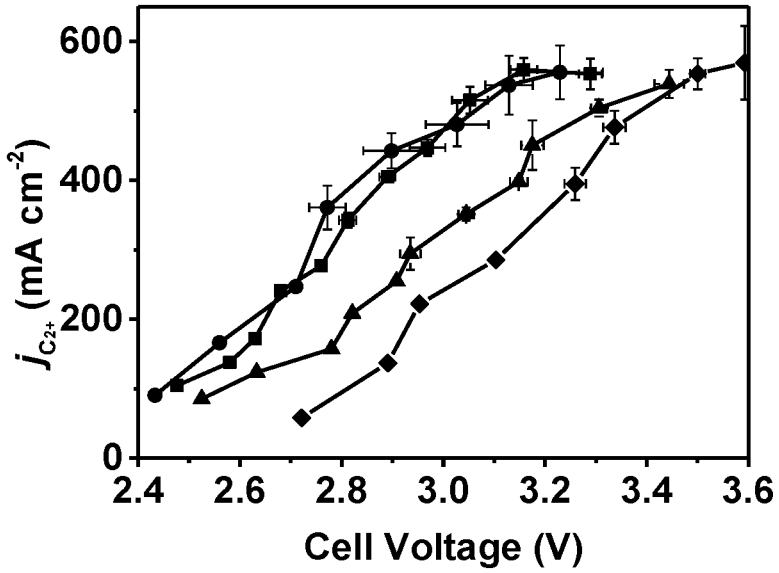
FIG. 2B is a graph showing the partial current density of $C_{2+}$ product for various electrode designs as a function of cell voltage. The electrodes are a Cu electrode and three embodiments of the present invention—L-type (as shown in FIG. 1A) Cu/Ag, I-type (as shown in FIG. 1B) Cu/Ag, and a layered structure (as shown in FIG. 1C) Cu/Ag.
Figure 2C:
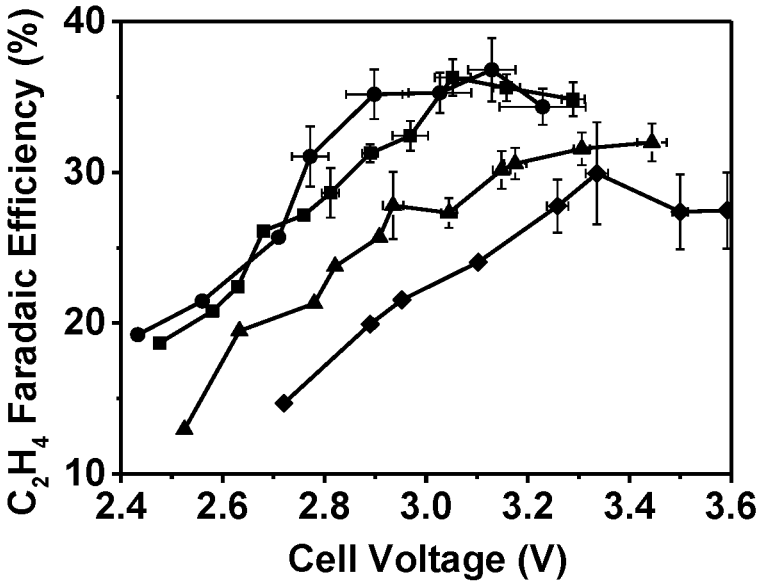
FIG. 2C is a graph showing the $C_2H_4$ Faradaic efficiency of various electrode designs as a function of cell voltage. The electrodes are a Cu electrode and three embodiments of the present invention—L-type (as shown in FIG. 1A) Cu/Ag, I-type (as shown in FIG. 1B) Cu/Ag, and a layered structure (as shown in FIG. 1C) Cu/Ag.
Figure 2D:
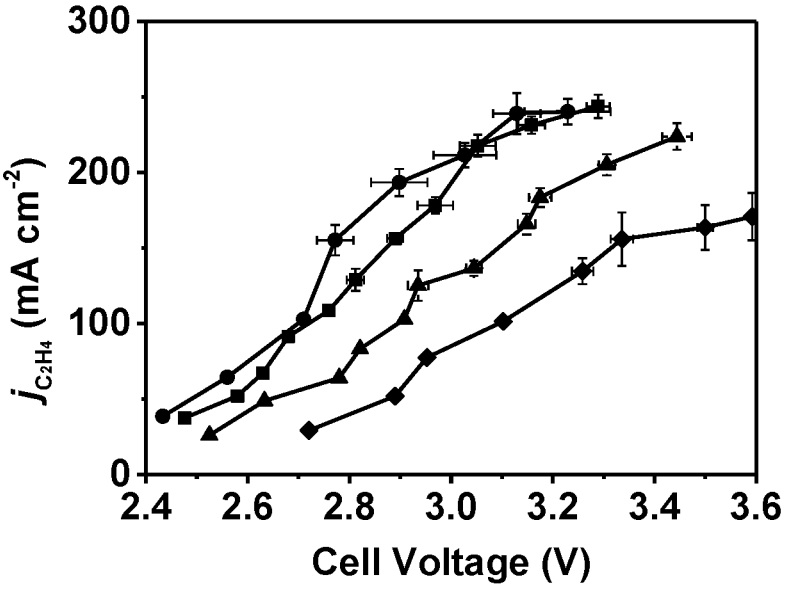
FIG. 2D is a graph showing the partial current density of $C_2H_4$ for various electrode designs as a function of cell voltage. The electrodes are a Cu electrode and three embodiments of the present invention—L-type (as shown in FIG. 1A) Cu/Ag, I-type (as shown in FIG. 1B) Cu/Ag, and a layered structure (as shown in FIG. 1C) Cu/Ag.
Figure 3A:
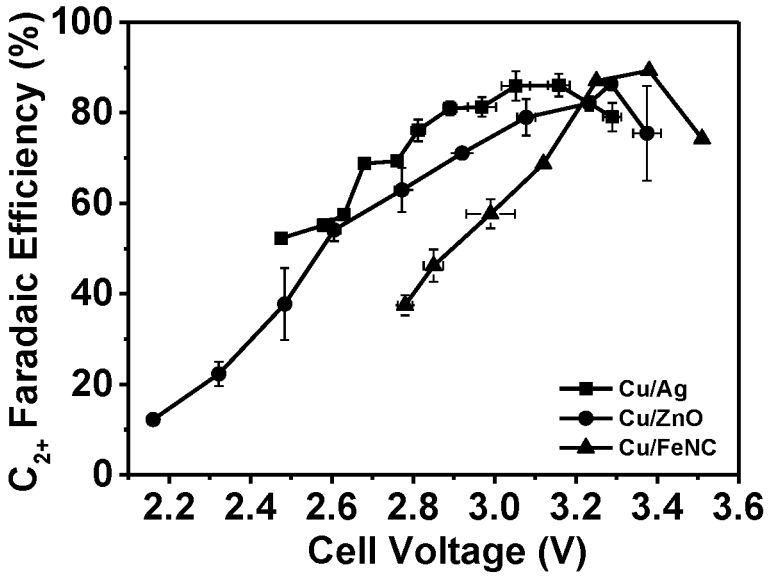
FIG. 3A is a graph showing a detailed comparison of Faradaic efficiency of $C_{2+}$ product for three different L-type tandem electrodes. The 30 layer/40 layer of the electrodes are Cu/Ag, Cu/ZnO, and Cu/Fe—N—C.
Figure 3B:
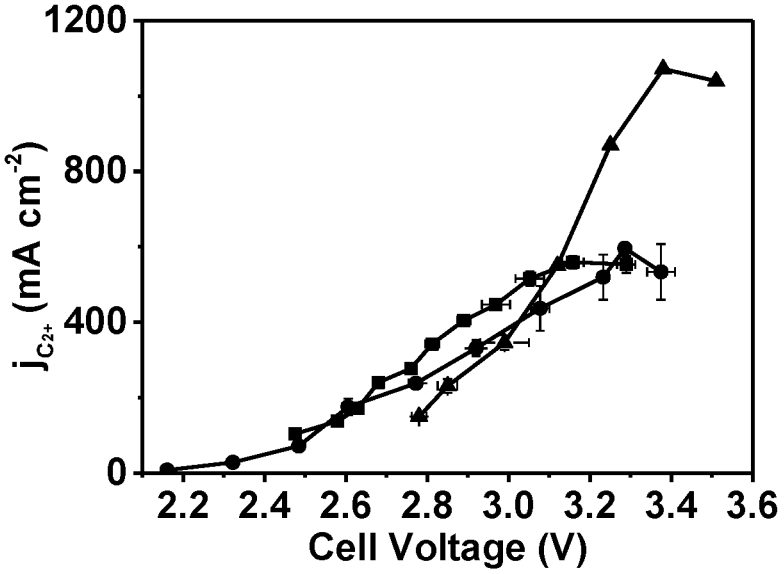
FIG. 3B is a graph showing the partial current density of $C_{2+}$ product for three different L-type tandem electrodes. The 30 layer/40 layer of the electrodes are Cu/Ag, Cu/ZnO, and Cu/Fe—N—C.
Figure 3C:
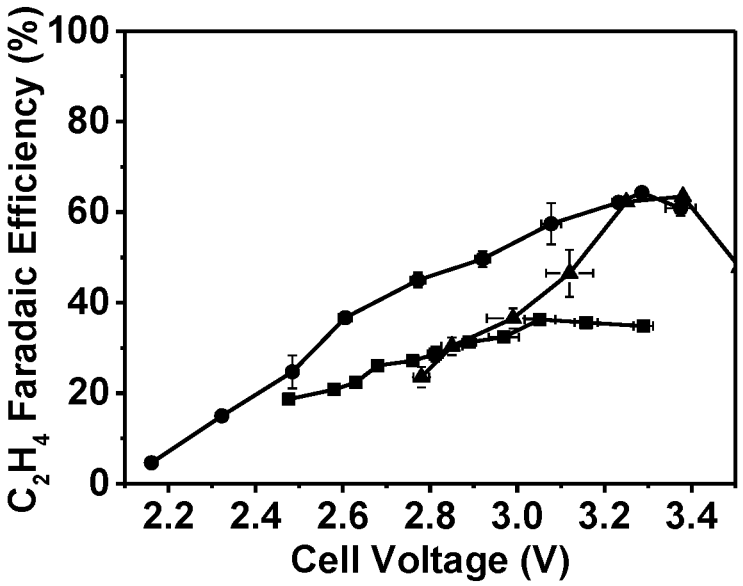
FIG. 3C is a graph showing a detailed comparison of Faradaic efficiency of $C_2H_4$ for three different L-type tandem electrodes. The 30 layer/40 layer of the electrodes are Cu/Ag, Cu/ZnO, and Cu/Fe—N—C.
Figure 3D:
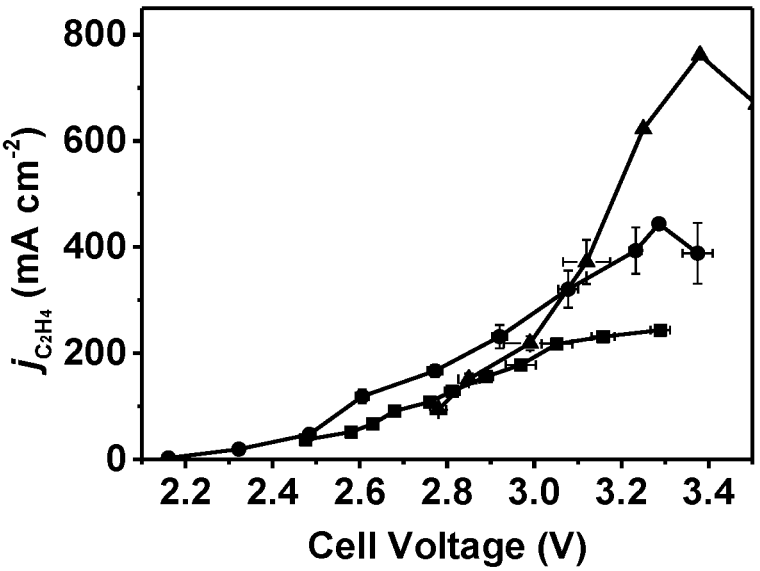
FIG. 3D is a graph showing the partial current density of $C_2H_4$ for three different L-type tandem electrodes. The 30 layer/40 layer of the electrodes are Cu/Ag, Cu/ZnO, and Cu/Fe—N—C.

In another embodiment, the tandem electrode of the present invention can have a layered structure, as shown in FIG. 1C. FIGS. 1D to 1F exemplify other arrangements of the $C_1$ hydrocarbon or $C_{2+}$ product-selective catalyst 30 and the CO-selective catalyst 40. In some embodiments, the sequence of layers CL 30 and CL40 shown in FIGS. 1A-1F may be reversed.

The substrate layer 10 can be any suitably supportive material that is permeable to gas. In one embodiment, the substrate layer 10 is selected from the group consisting of carbon fiber, metal foam, and combinations thereof. In some embodiments, the substrate layer 10 is hydrophobic. The microporous layer 20 distributes the gas in an even manner across the entire surface of the catalyst. In some embodiments, the microporous layer 20 is selected from the group consisting of carbon black layer, metal oxide layer, and metal layer. The CO-selective CL 40 converts $CO_2$ into CO, and $C_1$ hydrocarbon or $C_{2+}$ product-selective CL 30 further electro-reduces the mixture of $CO_2$ and CO into $CH_4$ or multi-carbon products, respectively.

The catalyst layers can be micrometer-scale thick. In some embodiments, the range of catalyst layer thickness is from about 10 nm to about 50 μm. In another embodiment, the area ratio of the multi-carbon-selective catalyst over the CO-selective catalyst varies from about infinite to about 1:1.

The electrode structure described in FIGS. 1A-1F is suitable for small size reactors. For a large size reactor that is used in industrial production, the described structures would be periodically repeated in the length direction, or both the length and width direction, or in all the length, width, and thickness direction of the electrode. In one embodiment, the shape of the catalyst layer is rectangular. In other embodiments, the shape of the catalyst layer is a circle, triangle, polygon, or another useful shape.

Voltages applied to the tandem electrode may range from about 1 V to about 5 V.

Examples

Preparation of Conventional and Tandem GDEs

For the preparation of pure Cu (Sigma, 25 nm) GDEs, 10 mg of Cu nanoparticles were first dispersed in a mixed solution containing 2 mL of the water, 8 mL of IPA and 15 μL of Nafion ionomer solution (Sigma, 5 wt. %). The suspension was then sonicated for ~1 h to form catalyst ink. GDEs were prepared by spraying the ink onto the carbon paper with a microporous carbon gas diffusion layer followed by drying at 130° C. in vacuum for 1 hour before testing. The tandem GDEs were fabricated by sequentially spraying Cu and Ag (or ZnO or Fe—N—C) catalyst layers on the carbon paper where the loadings were independently controlled by the amount of respective ink. Three types of tandem electrodes were prepared with the same amount of Cu and Ag (or ZnO or Fe—N—C) catalysts. The catalyst loading varies due to the different catalyst layer areas, ranging from 0.01 to 2 mg $cm^{-2}$.

Results

All three tandem electrodes (L-type, I-type and layered structure) exhibit improved Faradaic efficiency and partial current density of $C_{2+}$ products as well as the specific $C_2H_4$ compared to the pure Cu electrode (FIG. 2A-D). The L-type tandem electrode doubles the Faradaic efficiency of $C_{2+}$ products and $C_2H_4$ compared to the pure Cu electrode, especially at the low cell voltage region. The partial current densities of $C_{2+}$ products and $C_2H_4$ increases by one order of magnitude for L-type tandem electrode compared to pure Cu electrode at the low cell voltage range (<3 V).

The Faradaic efficiency and partial current density of $C_{2+}$ products as well as the specific $C_2H_4$ aligns with the production rate of CO of CO-selective catalysts (FIGs. 3A-D and FIGs. 5A-D). As Ag shows the highest production rate of CO at the low cell voltage, the Cu/Ag L- and I-type tandem electrodes show the highest Faradaic efficiency and partial current density of $C_{2+}$ products as well as the specific $C_2H_4$ at the low cell voltage region among Cu/Ag, Cu/ZnO, and Cu/Fe—N—C electrodes. At the high cell voltage region, Cu/Fe—N—C exceeds Cu/Ag in Faradaic efficiency and partial current density of $C_{2+}$ products. The 1 $A/cm^2$ of partial current density of $C_{2+}$ products is achievable on the Cu/Fe—N—C L-type tandem electrode.

Figure 4:
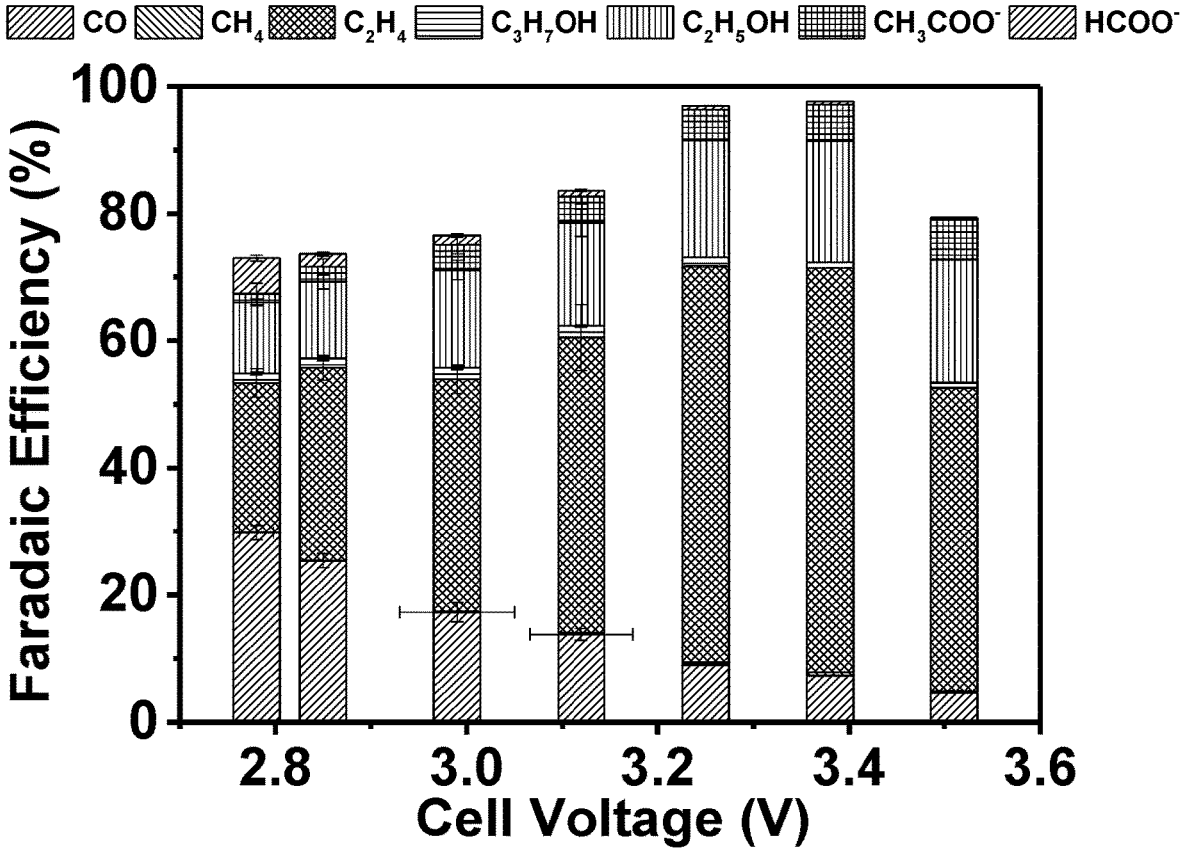
FIG. 4 is a graph showing the production distribution of various products from an L-type Cu/Fe—N—C tandem electrode. The products are CO, $CH_4$, $C_2H_4$, $C_3H_7OH$, $C_2H_5OH$, $CH_3COO^-$ and $HCOO^-$.
Figure 5A:
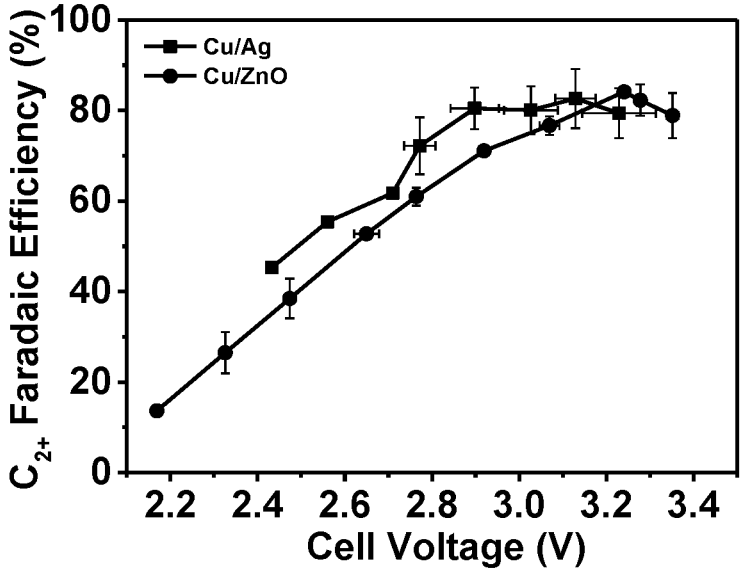
FIG. 5A is a graph showing a detailed comparison of Faradaic efficiency of $C_{2+}$ product for two different I-type tandem electrodes. The 30 layer/40 layer of the electrodes are Cu/Ag and Cu/ZnO.
Figure 5B:
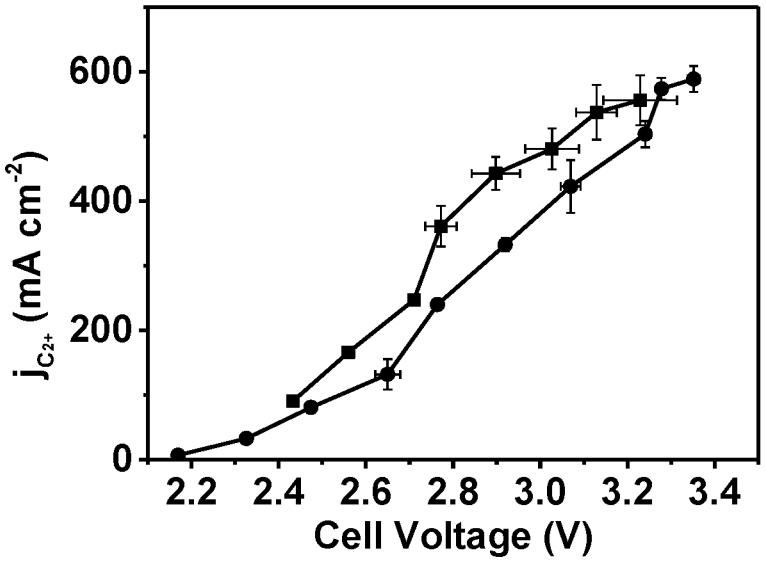
FIG. 5B is a graph showing the partial current density of $C_{2+}$ product for two different I-type tandem electrodes. The 30 layer/40 layer of the electrodes are Cu/Ag and Cu/ZnO.
Figure 5C:
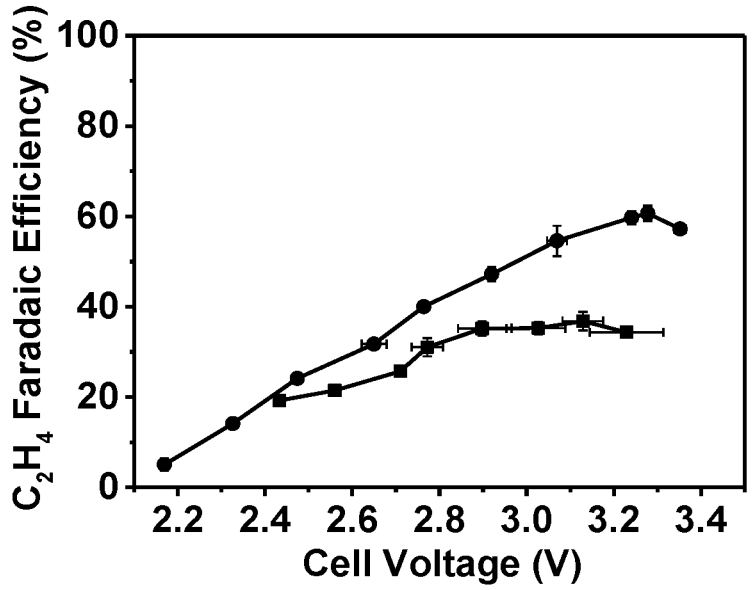
FIG. 5C is a graph showing a detailed comparison of Faradaic efficiency of $C_2H_4$ for two different I-type tandem electrodes. The 30 layer/40 layer of the electrodes are Cu/Ag and Cu/ZnO, and Cu/FeNC.
Figure 5D:
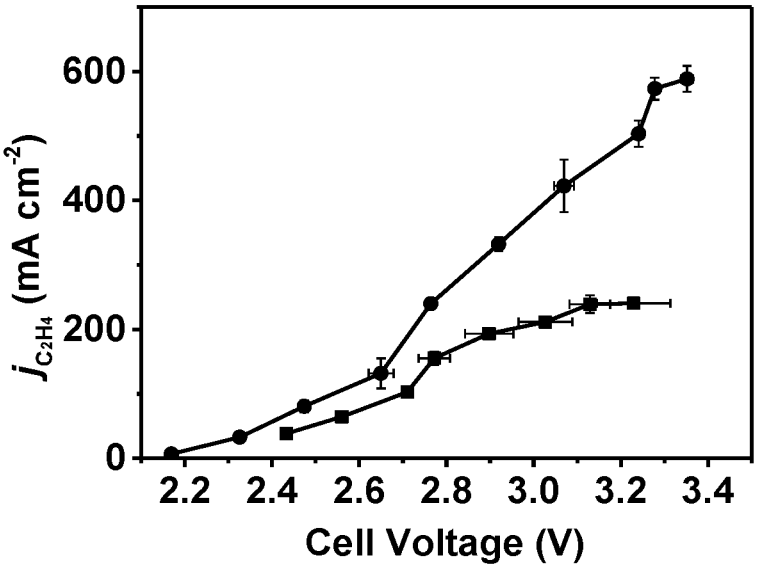
FIG. 5D is a graph showing the partial current density of $C_2H_4$ for two different I-type tandem electrodes. The 30 layer/40 layer of the electrodes are Cu/Ag and Cu/ZnO.

For Cu/Fe—N—C L-type tandem electrode, the $C_2H_4$ is the primary $C_{2+}$ products followed by $C_2H_5OH$ (FIG. 4). The Faradaic efficiency of $C_2H_4$ reaches over 62% on Cu/Fe—N—C L-type tandem electrode made of commercial 25 nm Cu nanoparticles and self-made Fe—N—C CO-selective catalyst. The primary of $C_{2+}$ products can be turned to $C_2H_5OH$ when the Cu or Cu alloy is selective to $C_2H_5OH$.

All documents cited are incorporated herein by reference; the citation of any document is not to be construed as an admission that it is prior art with respect to the present invention.

It is to be further understood that where descriptions of various embodiments use the term "comprising," and/or "including" those skilled in the art would understand that in some specific instances, an embodiment can be alternatively described using language "consisting essentially of" or "consisting of."

While particular embodiments of the present invention have been illustrated and described, it would be obvious to one skilled in the art that various other changes and modifications can be made without departing from the spirit and scope of the invention. It is therefore intended to cover in the appended claims all such changes and modifications that are within the scope of this invention.

What is claimed is:

1. A tandem electrode for electro-reduction of a carbon dioxide gas comprising a first distinct catalyst layer and a second distinct catalyst layer, wherein the first distinct catalyst layer comprises a C1 hydrocarbon or C2+ product selective catalyst and the second distinct catalyst layer comprises a CO selective catalyst; wherein the second distinct catalyst layer is concentrated at one lateral end of the tandem electrode, and further, wherein the first distinct catalyst layer has a top surface and the second distinct catalyst layer is located on the top surface and partially covers the first distinct catalyst layer.

2. The tandem electrode of claim 1 wherein the second distinct catalyst layer comprises multiple sections, and further, wherein each section is distinct from other sections and from the first distinct catalyst layer.

3. The tandem electrode of claim 2 further comprising a substrate layer.

4. The tandem electrode of claim 3 wherein the substrate layer is selected from the group consisting of carbon fiber, metal foam, and combinations thereof.

5. The tandem electrode of claim 3 wherein the substrate layer is hydrophobic.

6. The tandem electrode of claim 1 further comprising a microporous layer.

7. The tandem electrode of claim 1 wherein the first distinct catalyst is selected from the group consisting of Cu, Cu alloys, doped Cu, nitrogen doped carbon materials, boron doped carbon materials, nitrogen and boron co-doped carbon materials, and functionalized carbon materials.

8. The tandem electrode of claim 1 wherein the second distinct catalyst is selected from the group consisting of Au, Ag, Zn, ZnO, Fe—N—C, Ni—N—C, Co—N—C, N doped CNT, N doped graphene, and other materials that are selective for CO formation.

9. The tandem electrode of claim 1 wherein the first distinct catalyst is Cu and the second distinct catalyst layer is selected from the group consisting of Ag, ZnO and Fe—N4-C.

10. A method of electrochemically reducing carbon dioxide (CO2) comprising: a. exposing a gas comprising CO2 to a tandem electrode comprising a first distinct catalyst layer and a second distinct catalyst layer, wherein the first distinct catalyst layer comprises a C1 hydrocarbon or C2+ product selective catalyst and the second distinct catalyst layer comprises a CO selective catalyst; wherein the second distinct catalyst layer is concentrated at one lateral end of the tandem electrode, wherein the second distinct catalyst layer comprises multiple sections, and further, wherein each section is distinct from other sections and from the first distinct catalyst layer; b. applying a voltage to the tandem electrode; and c. producing a reduction product of carbon dioxide.

11. The method of claim 10 further comprising a microporous layer.

12. The method of claim 11 further comprising a substrate layer.

13. The method of claim 12 wherein the substrate layer is selected from the group consisting of carbon fiber, metal foam, and combinations thereof.

14. The method of claim 12 wherein the substrate layer is hydrophobic.

15. The method of claim 10 wherein the first distinct catalyst layer is selected from the group consisting of Cu, Cu alloys, doped Cu, nitrogen doped carbon materials, boron doped carbon materials, nitrogen and boron co-doped carbon materials, and functionalized carbon materials.

16. The method of claim 10 wherein the second distinct catalyst layer is selected from the group consisting of Au, Ag, Zn, ZnO, Fe—N—C, Ni—N—C, Co—N—C, N doped CNT, N doped graphene, and other materials that are selective for CO formation.

17. The method of claim 10 wherein the first distinct catalyst layer is Cu and the second distinct catalyst layer is selected from the group consisting of Ag, ZnO and Fe—N—C.

18. A tandem electrode for electro-reduction of a carbon dioxide gas comprising a first distinct catalyst layer and a second distinct catalyst layer, wherein the first distinct catalyst layer comprises a C1 hydrocarbon or C2+ product selective catalyst and the second distinct catalyst layer comprises a CO selective catalyst; wherein the second distinct catalyst layer is concentrated at one lateral end of the tandem electrode, wherein the second distinct catalyst layer comprises multiple sections, and further, wherein each section is distinct from other sections and from the first distinct catalyst layer.

19. The tandem electrode of claim 18 further comprising a substrate layer wherein the substrate layer is selected from the group consisting of carbon fiber, metal foam, and combinations thereof.

20. The tandem electrode of claim 19 wherein the substrate layer comprises metal foam.

* * * * *